US011508299B2

(12) United States Patent
Huang et al.

(10) Patent No.: US 11,508,299 B2
(45) Date of Patent: Nov. 22, 2022

(54) PIXEL DRIVING CIRCUIT, DRIVING METHOD THEREOF, AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Shiqiang Huang, Beijing (CN); Wei Hu, Beijing (CN); Huiche Lin, Beijing (CN); Jie Yang, Beijing (CN)

(73) Assignees: CHONGQING BOE OPTOELECTRONICS TECHNOLOGY CO., LTD., Chongqing (CN); Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 16/622,266

(22) PCT Filed: Aug. 6, 2019

(86) PCT No.: PCT/CN2019/099438

§ 371 (c)(1),
(2) Date: Dec. 12, 2019

(87) PCT Pub. No.: WO2020/155597

PCT Pub. Date: Aug. 6, 2020

(65) Prior Publication Data

US 2021/0350745 A1 Nov. 11, 2021

(30) Foreign Application Priority Data

Jan. 28, 2019 (CN) ..... 201910078404.5

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ... G09G 3/32–3291; G09G 2300/0842; G09G 2300/0819; G09G 2300/0861; G09G 2300/0866
See application file for complete search history.

(56) References Cited

U.S. PATENT DOCUMENTS 10,332,447 B2 * 6/2019 Li ..... G09G 3/3233
10,726,782 B2 * 7/2020 Gao ..... G09G 3/3266
(Continued)

FOREIGN PATENT DOCUMENTS

CN 1794327 A 6/2006
CN 101286298 A 10/2008
(Continued)

OTHER PUBLICATIONS

State Intellectual Property Office of the People's Republic of China, Office Action and Search Report Issued in Application No. 201910078404.5, dated May 7, 2020, 10 pages. (Submitted with Partial Translation).

(Continued)

*Primary Examiner* — Patrick F Marinelli
(74) *Attorney, Agent, or Firm* — McCoy Russell LLP

(57) ABSTRACT

The present disclosure provides a pixel driving circuit, a driving method thereof, and a display device. In one example, the pixel driving circuit includes: a driving transistor; a voltage holding sub-circuit, the first end of the voltage holding sub-circuit connected to the gate of the driving transistor; a data writing sub-circuit configured to supply a data voltage to the driving transistor when the first scanning line is at a first level, and connect the gate of the (Continued)

driving transistor and a second electrode; a converting sub-circuit configured to supply illumination power voltage to a second end of the voltage holding sub-circuit when the second scanning line is at the first level, and connect the second end of the voltage holding sub-circuit to the second end of the driving transistor when the third scanning line is at the first level; and a switch sub-circuit configured to supply illumination power voltage to the first end of the driving transistor when the third scanning line is at the first level, and connect the second end of the drive transistor to the current output end of the pixel drive circuit. The present disclosure can achieve threshold voltage compensation for the drive transistor.

19 Claims, 7 Drawing Sheets

(52) U.S. Cl.
CPC ..... *G09G 2320/0233* (2013.01); *G09G 2320/045* (2013.01)

(56) References Cited

U.S. PATENT DOCUMENTS

| | | | | |
|---|---|---|---|---|
| 10,762,840 | B2 * | 9/2020 | Zhou | G09G 3/325 |
| 10,937,852 | B2 * | 3/2021 | Hong | G09G 3/3275 |
| 11,232,741 | B2 * | 1/2022 | Hyun | G09G 3/32 |
| 11,373,588 | B2 * | 6/2022 | Kim | G09G 3/32 |
| 2008/0170008 | A1 | 7/2008 | Kim | |
| 2011/0304593 | A1 | 12/2011 | Huang et al. | |
| 2013/0222440 | A1 * | 8/2013 | Ikeda | G09G 3/3258 345/77 |
| 2019/0244568 | A1 * | 8/2019 | Ling | G09G 3/3233 |
| 2019/0371238 | A1 * | 12/2019 | Gao | G09G 3/3266 |
| 2021/0225266 | A1 * | 7/2021 | Hyun | G09G 3/3233 |
| 2021/0248959 | A1 * | 8/2021 | Kim | G09G 3/3266 |
| 2021/0256908 | A1 * | 8/2021 | Park | G09G 3/3275 |
| 2021/0320237 | A1 * | 10/2021 | Kim | H01L 25/0753 |
| 2021/0350745 | A1 * | 11/2021 | Huang | G09G 3/3233 |
| 2022/0051633 | A1 * | 2/2022 | Li | G09G 3/3266 |

FOREIGN PATENT DOCUMENTS

| | | | | |
|---|---|---|---|---|
| CN | 102013230 | A | | 4/2011 |
| CN | 102903333 | A | * | 1/2013 |
| CN | 102903333 | A | | 1/2013 |
| CN | 103295524 | A | | 9/2013 |
| CN | 104103239 | A | | 10/2014 |
| CN | 104252844 | A | | 12/2014 |
| CN | 105206220 | A | | 12/2015 |
| CN | 105225626 | A | | 1/2016 |
| CN | 105679245 | A | | 6/2016 |
| CN | 107342050 | A | | 11/2017 |
| CN | 107358917 | A | | 11/2017 |
| CN | 108492780 | A | | 9/2018 |
| CN | 108735155 | A | | 11/2018 |
| CN | 108962143 | A | | 12/2018 |
| KR | 100893481 | B1 | | 4/2009 |

OTHER PUBLICATIONS

ISA National Intellectual Property Administration of the People's Republic of China, International Search Report and Written Opinion Issued in application No. PCT/CN2019/099438, WIPO, 11 pages.

* cited by examiner

PIXEL DRIVING CIRCUIT, DRIVING METHOD THEREOF, AND DISPLAY DEVICE

CROSS-REFERENCE TO RELATED APPLICATIONS

The present application is a U.S. National Phase of International Patent Application Serial No. PCT/CN2019/099438 entitled "PIXEL DRIVING CIRCUIT, DRIVING METHOD THEREOF, AND DISPLAY DEVICE," filed on Aug. 6, 2019. International Patent Application Serial No. PCT/CN2019/099438 claims priority to Chinese Patent Application No. 201910078404.5 filed on Jan. 28, 2019. The entire contents of each of the above-referenced applications are hereby incorporated by reference for all purposes.

TECHNICAL FIELD

The present disclosure generally relates to the field of display technologies, and embodiments of a pixel driving circuit, a driving method thereof, and a display device.

BACKGROUND

Organic Light Emitting Diode (OLED) display technology is a display technology widely used in televisions and mobile devices. It is self-illuminating with low power consumption, and has a wide range of application prospects in portable electronic devices that are sensitive to power consumption. A display device, such as an OLED display device, includes a plurality of sub-pixel units arranged in an array, and different images are displayed by controlling the illumination of the respective sub-pixel units. A plurality of individual organic light emitting diodes may correspond to a single sub-pixel. The sub-pixels are the fundamental sub-systems (such as a building blocks) for constituting the pixels in the display.

Currently, in the field of OLED display panels, the driving transistor for providing current output to light emitting devices may have issues regarding its evenness (uniformity) and stability due to difficulties in the production process, and these problems may cause differences in threshold voltage of driving transistors in different sub-pixels. Further, these problems may cause unpredictable changes in the threshold voltage of the driving transistors over time of usage, leading to uneven and unstable current output from the driving transistors in a plurality of sub-pixels corresponding to the light emitting devices, causing uneven brightness of the display screen. Due to the unstable current output, the quality (performance) of the display degrades over time, which may adversely affect the performance of the product with the display.

SUMMARY

In one example, the issues described above may be addressed by a pixel driving circuit, a driving method thereof, and a display device, which can implement threshold voltage compensation of a driving transistor to help improve display performance.

In a first aspect, the present disclosure provides a pixel driving circuit, the pixel driving circuit comprising: driving transistor, a voltage holding sub-circuit with a first end of the voltage holding sub-circuit coupled to a gate of the driving transistor, the voltage holding sub-circuit configured to maintain a voltage between the first end and a second end of the voltage holding sub-circuit; a data writing sub-circuit respectively connected to each of a first scan line, a gate, the first pole and a second pole of the driving transistor, the data writing sub-circuit configured to provide a data voltage to the first pole of the driving transistor when the first scan line is at a first level, and turning on the gate of the driving transistor and the second pole of the driving transistor; a conversion sub-circuit, the conversion sub-circuit respectively connected to each of a second scan line, a third scan line, the second pole of the driving transistor, and the second end of the voltage holding sub-circuit, the conversion sub-circuit configured to provide an illumination power supply voltage to the second end of the voltage holding sub-circuit when the second scan line is at a second level, and connecting the second end of the voltage holding sub-circuit and the second pole of the driving transistor when the third scan line is at a third level; a switch sub-circuit respectively connected to each of the third scan line, a current output terminal of the pixel drive circuit, and first and second poles of the driving transistor, the switch sub-circuit configured to provide the illumination power supply voltage to the first pole of the driving transistor when the third scan line is at the third level, and connecting the second pole of the driving transistor and the current output terminal of the pixel driving circuit; wherein the first pole and the second pole of the drive transistor are one of a source and a drain, respectively.

In the preceding example system, additionally or optionally, the second scan line and the third scan line are a same scan line, and wherein a first level on the third scan line corresponds to but is a different voltage value than a second level on the second scan line. In any or all of the preceding examples, additionally or optionally, the voltage holding sub-circuit comprises a first capacitor with a first end of the first capacitor being a first end of the voltage holding sub-circuit and a second end of the first capacitor being a second end of the voltage holding sub-circuit.

In any or all of the preceding examples, additionally or optionally, the data writing sub-circuit comprises each of a first transistor and a second transistor, wherein a gate of the first transistor is connected to the first scan line, a first pole of the first transistor is connected to a signal line providing the data voltage, and a second pole of the first transistor is connected to the first pole of the driving transistor, and wherein a gate of the second transistor is connected to the first scan line, a first pole of the second transistor is connected to the first end of the voltage holding sub-circuit, and a second pole of the second transistor is connected to the second pole of the driving transistor.

In any or all of the preceding examples, additionally or optionally, the conversion sub-circuit comprises each of a third transistor and a fourth transistor, wherein a gate of the third transistor is connected to the second scan line, a first pole of the third transistor is connected to a signal line providing the illumination power supply voltage, and a second pole of the third transistor is connected to the second end of the voltage holding sub-circuit, and wherein a gate of the fourth transistor is connected to the third scan line, a first pole of the fourth transistor is connected to the second end of the voltage holding sub-circuit, and a second pole of the fourth transistor is connected to the second pole of the driving transistor.

In any or all of the preceding examples, additionally or optionally, the switch sub-circuit comprises each of a fifth transistor and a sixth transistor, wherein a gate of the fifth transistor is connected to the third scan line, a first pole of the fifth transistor is connected to a signal line providing the illumination power supply voltage, and a second pole of the fifth transistor is connected to the first pole of the driving transistor, and wherein a gate of the sixth transistor is connected to the third scan line, a first pole of the sixth transistor is connected to a second pole of the driving transistor, and a second pole of the sixth transistor is connected to the current output terminal of the pixel driving circuit.

In any or all of the preceding examples, additionally or optionally, the pixel driving circuit further comprises an initializing sub-circuit, wherein the initializing sub-circuit is connected to each of a fourth scan line and first end of the voltage holding sub-circuit, the initialization sub-circuit providing an initialization voltage to the first end of the voltage holding sub-circuit when the fourth scan line is at a first level.

In any or all of the preceding examples, additionally or optionally, the initializing sub-circuit comprises a seventh transistor, wherein a gate of the seventh transistor is connected to the fourth scan line, a first pole of the seventh transistor is connected to the first end of the voltage holding sub-circuit, and a second pole of the seventh transistor is connected to a signal line providing the initialization voltage.

In a second aspect, the pixel driving circuit is incorporated in a display device, the display device comprising at least one pixel driving circuit of any of the above claims.

In a third aspect, the present disclosure further provides a driving method of any one of the above pixel driving circuits, where the driving method includes:

providing a first level to a second scan line to set a voltage at a second end of a voltage hold sub-circuit to an illumination power supply voltage; providing a first level to a first scan line to set a voltage at a first end of the voltage hold sub-circuit to a sum of a data voltage and a threshold voltage of the drive transistor; providing a first level to a third scan line to electrically connect a current output terminal of the pixel driving circuit to each of the first end of the voltage hold sub-circuit and a second end of the driving transistor, and setting a voltage at a first pole of the driving transistor to the illumination power supply voltage. In the preceding example system, additionally or optionally, further comprising, providing an initialization voltage to the first end of the voltage holding sub-circuit when a fourth scan line is at a first level. In any or all of the preceding examples, additionally or optionally, the initialization voltage is provided through a pixel initializing sub-circuit connected to each of the fourth scan line and the first end of the voltage holding sub-circuit of the pixel driving circuit. In any or all of the preceding examples, additionally or optionally, the current output terminal of the pixel driving circuit supplies an illumination current to a light emitting device, one or more light emitting devices forming sub-pixels in a display. In any or all of the preceding examples, additionally or optionally, the illumination current is a function of an illumination power supply voltage supplied at a switch sub-circuit of the pixel driving circuit and a data voltage supplied at a data writing sub-circuit, the illumination current independent of the threshold voltage of the driving transistor. In any or all of the preceding examples, additionally or optionally, the providing the first level to the second scan line is during a data writing phase in a display period, wherein the providing the first level to the first scan line is during the data writing phase, and the providing the first level to the third scan line is during an illumination phase in the display period. In any or all of the preceding examples, additionally or optionally, each of the first level at the first scan line, the first level at the first scan line, and the first level at the third scan line provide distinct preset voltage ranges.

The technical effect of adjusting the signal supplied to each scanning line according to the above mentioned driving method is that the pixel driving circuit can operate such that the illumination current output (also referred herein as light-emitting current) from the current output end of the pixel driving circuit is independent of the threshold voltage of the driving transistor. In this way, a threshold voltage compensation for differences in threshold voltage of the driving transistor may be achieved. When the output current of each pixel driving circuit is independent of the threshold voltage of the driving transistor, the variation of the threshold voltage of the driving transistor will not affect the luminance of the light emitting device, and thus the present disclosure can enhance operation of an OLED display that is illuminated via a illumination current supplied via the pixel driving circuit. The brightness uniformity of the display device helps to improve the display performance and reliability of the display device.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the summary above does not constitute an admission that the technical problems and challenges discussed were known to anyone other than the inventors.

BRIEF DESCRIPTION OF DRAWINGS

The drawings in the following description are only some embodiments of the present disclosure. Reasonable variations of these figures are also encompassed within the scope of the present disclosure.

DETAILED DESCRIPTION

The following description relates to a pixel driving circuit, control methods thereof, and a display device including the pixel driving circuit. The embodiments of the present disclosure will be further described in detail below with reference to the accompanying figures. It is apparent that the described embodiments are part of the embodiments of the present disclosure, and not all of the embodiments. All other embodiments obtained by a person of ordinary skill in the art based on the described embodiments of the present disclosure without departing from the scope of the invention are within the scope of the disclosure. Unless otherwise defined, technical terms or scientific terms used in the present disclosure are intended to be understood in the ordinary meaning of the ordinary skill of the art. The words "first," "second," and similar terms used in the present disclosure do not denote any order, quantity, or importance, but are used to distinguish different components. "Comprising" or similar terms means that the elements or objects that appear before the word include the elements or items that appear after the word and their equivalents, and do not exclude other elements or items. The words "connected" and the like are not limited to physical or mechanical connections, but may include electrical connections, and the connections may be direct or indirect.

Figure 1:
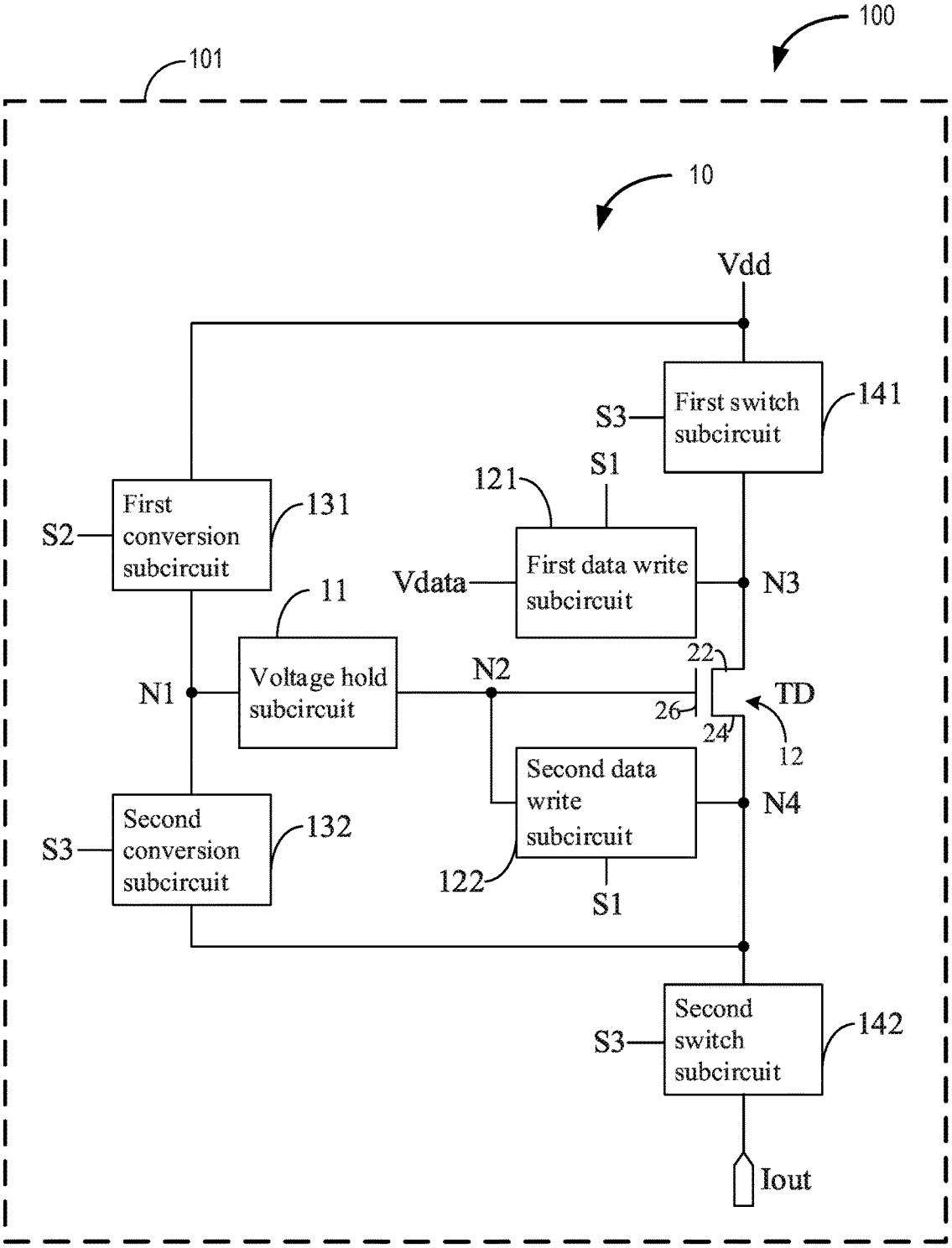
FIG. 1 shows a structural block diagram of a pixel driving circuit according to an embodiment of the present disclosure FIG. 2 show a schematic flow chart of a driving method of a pixel driving circuit according to an embodiment of the present disclosure.

FIG. 1 is a structural block diagram 100 of a pixel driving circuit 10 according to an embodiment of the present disclosure. The pixel driving circuit 101 may be included in a display such as an Organic Light Emitting Diode (OLED) display 101. In FIG. 1, the pixel driving circuit 10 includes a current output terminal Iout for supplying an illumination current to a light emitting device (such as OLED), the circuit 10 further including a driving transistor TD 12, a voltage holding sub-circuit 11, a data writing sub-circuit including a first data writing sub-circuit 121 and a second data write sub-circuit 122, a conversion sub-circuit including a first conversion sub-circuit 131 and a second conversion sub-circuit 132, and a switch sub-circuit including a first switch sub-circuit 141 and a second switch sub-circuit 142. It should be understood that the current output terminal Iout of the pixel driving circuit may, for example, be connected to one electrode of the light emitting device to enable the pixel driving circuit to provide a illumination current for the light emitting device, and the light emitting device may be included as part of the pixel driving circuit.

In one example, the first data writing sub-circuit 121 and the second data write sub-circuit 122 may together constitute a data writing circuit of the pixel driving circuit 101, the first conversion sub-circuit 131 and the second conversion sub-circuit 132 may together constitute a conversion circuit of the pixel driving circuit 101, and the first switch sub-circuit 141 and the second switch sub-circuit 142 may constitute a switch circuit of the pixel driving circuit 101. As further elaborated in relation to FIG. 3, each of the first data writing sub-circuit 121, the second data write sub-circuit 122, the first conversion sub-circuit 131, the second conversion sub-circuit 132, the first switch sub-circuit 141, and the second switch sub-circuit 142 may include distinct transistors coupled to scan lines.

The driving transistor TD 12 includes a gate 26, a first pole 22 and a second pole 24, and the first pole 22 and the second pole 24 are a source and a drain, respectively. In FIG. 1, the one pole of the driving transistor TD 12 connected to the third node N3 is the first pole 22 of the driving transistor TD 12, and the another pole of the driving transistor TD 12 connected to the fourth node N4 is the second pole 24 of the driving transistor TD 12. The gate 26 of the driving transistor TD 12 is connected to the second node N2. It should be noted that, depending on the specific type of the transistor, the connection relationship between the source and the drain may be separately set to match the direction of the current flowing through the transistor; and the transistor may have a symmetrical structure of the source and the drain. The source and drain may be considered as two electrodes that are not particularly distinguished.

The voltage holding sub-circuit 11 has a first end and a second end. The one end of the voltage holding sub-circuit 11 connected to the second node N2 in FIG. 1 is a first end of the voltage holding sub-circuit 11, and the other end of the voltage holding sub-circuit 11 connected to the first node N1 is the second end of the voltage holding sub-circuit 11. As shown in FIG. 1, the first end of the voltage holding sub-circuit 11 is connected to the gate 26 of the driving transistor TD. The voltage holding sub-circuit 11 is for maintaining the voltage between its first end and the second end. It should be understood that the voltage holding sub-circuit 11 may not play its role of maintaining the voltage between the first end and the second end when there is voltage input at the first end and/or the second end thereof, but when both the first end and the second end have no voltage input, the voltage holding sub-circuit 11 plays the role of maintaining the voltage between the first end and the second end.

The data writing sub-circuit is respectively connected to a first scan line S1 and the gate 26, the first pole 22 and the second pole 24 of the driving transistor TD 12. The first data writing sub-circuit 121 may be connected to the first scan line S1 and the first pole of the driving transistor TD, respectively, the first data writing sub-circuit 121 configured to supply a modified data voltage Vdata to the first pole of the driving transistor TD when the first scan line S1 is at a first level. As the data voltage Vdada passes through a transistor of the first data writing circuit, there may be a drop in the original data voltage Vdata and the modified data voltage Vdata is supplied to the first pole of the driving transistor TD. The second data writing sub-circuit 122 may be connected to the first scan line S1 and the gate 26 and a second pole 24 of the driving transistor TD 12, the second data writing sub-circuit 122 configured to drive the gate 26 and the second pole 24 of the driving transistor TD when the first scan line S1 is at the first level. It should be noted that the first level and a second level of a scan line as herein refer to two different voltage ranges preset for signals or circuit nodes. In one example, the first level is a higher level relative to the second level. In another example, the first level on the first scan line S1 is a lower level while the first level at a second scan line S2 is a higher level. It should also be noted that the expression "providing the first level" means that the voltage of the target signal or circuit node is at the first level, for example, by providing an electrical signal, connecting other signals, or connecting other circuit nodes.

In one example embodiment, each of the first scan line, the second scan line, and the third scan line are a same (common) scan line. The voltage range supplied to the common scan line may be varied to selectively activate one or more transistors (based on the threshold voltage of the transistor). As an example, if a first voltage level is supplied to the common scan line, a first transistor may be activated, if a second voltage level is supplied to the common scan line, a second transistor may be activated, and if a third voltage level is supplied to the common scan line, each of the first transistor and the second transistor may be activated.

The conversion sub-circuit is respectively connected to the second scan line S2, the third scan line S3, the second pole 24 of the driving transistor TD 12, and the second end of the voltage holding sub-circuit 11. The first conversion sub-circuit 131 is connected to the second scan line S2, the first conversion sub-circuit 131 configured to supply an illumination power supply voltage $V_{dd}$ to the second end of the voltage hold sub-circuit 11 when the second scan line S2 is at the first level. The second conversion sub-circuit 132 is connected to the third scan line S3, a second end of the voltage hold sub-circuit 11 and a second pole 24 of the drive transistor TD. The second conversion sub-circuit 132 is configured to electrically connect the voltage hold sub-circuit 11 and the second pole 24 of the driving transistor TD when the third scan line S3 is at the first level.

The switch sub-circuit is respectively connected to the third scan line S3, the current output terminal Iout of the pixel driving circuit, and the first and second poles of the driving transistor TD 12. The first switch sub-circuit 141 is respectively connected to the third scan line S3 and the first pole 22 of driving transistor TD 12, the first switch sub-circuit 141 configured to provide a illumination power supply voltage Vdd to the first pole 22 of the driving transistor TD when the third scan line S3 is at a first level. The second switch sub-circuit 142 is respectively connected to the third scan line S3, a current output terminal Iout of the pixel driving circuit, and the second pole 24 of the driving transistor TD 12. The second switch sub-circuit 142 is configured to, when the third scan line S3 is at a first level, connecting the second pole 24 of the driving transistor TD to the current output terminal Iout of the pixel driving circuit.

Figure 2:
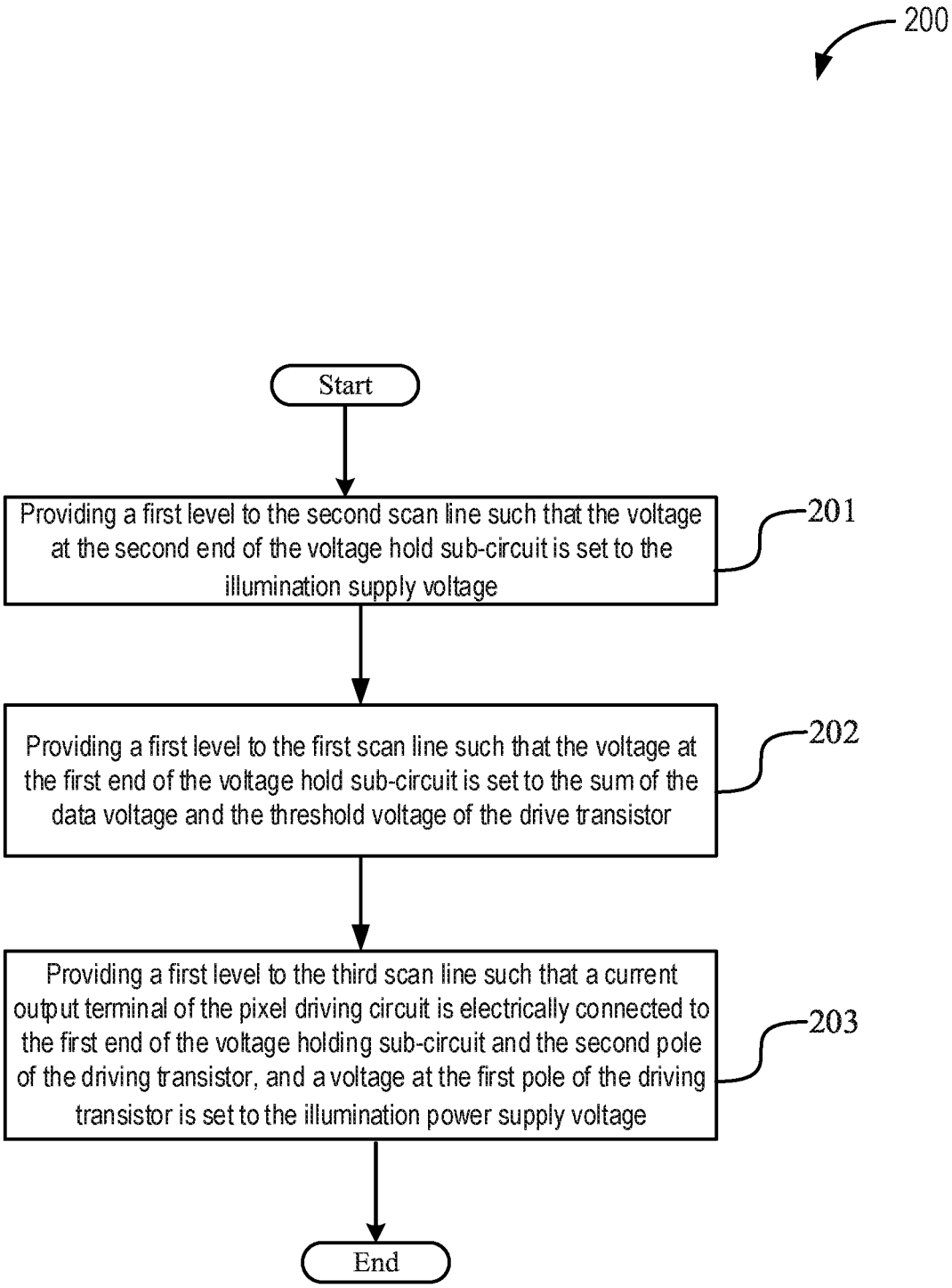

As an example of the driving method of the pixel driving circuit, FIG. 2 is a schematic flowchart of a driving method of the pixel driving circuit described in relation to FIG. 1. Referring to FIG. 2, the driving method includes: in step 201, a first level is provided to the second scan line S2 such that the voltage at a second end of the voltage hold sub-circuit (e.g. 11) is set to the light-emitting (illumination) power supply voltage Vdd.

In one example, the above mentioned step may occur in a data writing phase in each display period (eg. display frame) during which the first conversion sub-circuit 131 supplies illumination power supply voltage $V_{dd}$ to the first node N1 where the second end of the voltage holding sub-circuit is located, to initialize the holding voltage of the voltage holding sub-circuit. In one example, a display frame may include one or more display periods. At a display period, a specific light emitting element such as a sub-pixel may be illuminated.

In step 202, a first level is provided to the first scan line S1 such that the voltage at a first end of the voltage hold sub-circuit (e.g. 11) is set to a sum of the data voltage (Vdata) and the threshold voltage ($V_{th}$) of the drive transistor TD.

In one example, step 202 also occurs in a data writing phase in each display period (e.g., display frame) during which the first data write sub-circuit (e.g. 121) is electrically connected to the drive transistor TD. The third node N3 where the first pole of the drive transistor TD is located is provided the data voltage Vdata. The second data writing sub-circuit (e.g. 122) connects the fourth node N4 where the second pole of the driving transistor TD is located and the second node N2 where the gate of the driving transistor TD is located, so that a current is formed between the second node N2 and the third node N3, until the difference between the voltage at the second node N2 and the voltage at the third node N3 is equal to the threshold voltage $V_t$h of the driving transistor TD, that is, the voltage at the second node N2 is finally stabilized at a value equal to the sum of the data voltage Vdata and the threshold voltage Vth of the driving transistor TD. It may be inferred that the voltage held by the voltage holding sub-circuit between the first end and the second end of the voltage holding sub-circuit at the end of the data writing phase is equal to Vdd−(Vdata−Vth).

In step 203, a first level is provided to the third scan line such that the current output terminal of the pixel driving circuit is electrically connected to the first end of the voltage holding sub-circuit and the second pole of the driving transistor, and a voltage at the first pole of the driving transistor is set to the illumination power supply voltage.

In one example, step 203 occurs in the illumination phase in each display period (e.g., display frame) following the data writing phase, i.e., the beginning of the illumination phase and the end time of the data writing phase. During the illumination phase the first switch sub-circuit (e.g. 141) may supply the illumination power supply voltage Vdd to the third node N3 where the first pole of the drive transistor TD is located, and the second switch sub-circuit (e.g. 142) may drive the drive transistor TD. The fourth node N4, where the second pole is located is electrically connected to the current output terminal Tout of the pixel driving circuit so that the driving transistor TD can supply the illumination current from the current output terminal (Tout) under the power supply of the illumination power supply voltage Vdd. At this time, the second conversion sub-circuit (e.g. 132) electrically connects the first node N1 where the second end of the voltage holding sub-circuit is located and the fourth node N4 where the second pole of the driving transistor TD is located, that is, the voltage at the first node N1 changes from the illumination power supply voltage Vdd to the current voltage Vn4 at the fourth node N4. As the voltage holding sub-circuit holds the voltage between the first end and the second end, the voltage Vn2 at the second node N2 is equal to Vdata+Vth−Vdd+Vn4. At this time, the source-drain current Ids of the driving transistor TD may be calculated based on equation 1:

$$\begin{aligned} Ids &= K[Vn2 - Vn4 - Vth]^2 \\ &= K(Vdata + Vth - Vdd + Vn4) - Vn4 - Vth]^2 \\ &= K[Vdata - Vdd]^2 \end{aligned} \tag{1}$$

Where K is a parameter related to the shape configuration of the driving transistor TD. The current value of the light-emission current outputted from the current output terminal Tout may be directly proportional to the source-drain current Ids. In one example, current value of the light-emission current outputted from the current output terminal Tout may be equal to the source-drain current Ids. Thus, the current value of the light-emission current outputted from the current output terminal Tout is related to the data voltage Vdata and the illumination power supply voltage Vdd regardless of the threshold voltage Vth of the drive transistor TD. Therefore, when the light-emission driving of each sub-pixel is realized by the operation of the above-described pixel driving circuit, the light-emitting luminance of different light-emitting devices in different sub-pixels will not be affected by the threshold voltage Vth of the driving transistor TD, thereby providing uniformity among all the sub-pixels.

It can be seen that, when a signal is supplied to each scanning line according to the above driving method, that the pixel driving circuit can operate such that the illumination current output (also referred herein as light-emitting current) from the current output end of the pixel driving circuit is independent of the threshold voltage of the driving transistor. The threshold voltage compensation of the drive transistor is achieved and the illumination current value is independent of the threshold voltage Vth. When the output current of each of the pixel driving circuits is independent of the threshold voltage of the driving transistor TD, the variation of the threshold voltage of the driving transistor TD will not affect the luminance of the light emitting device, and thus the embodiment of the present disclosure can improve the uniformity in brightness of display devices that are illuminated by current, such as the OLED display, which helps to improve the display performance and reliability of the display device.

Figure 3:
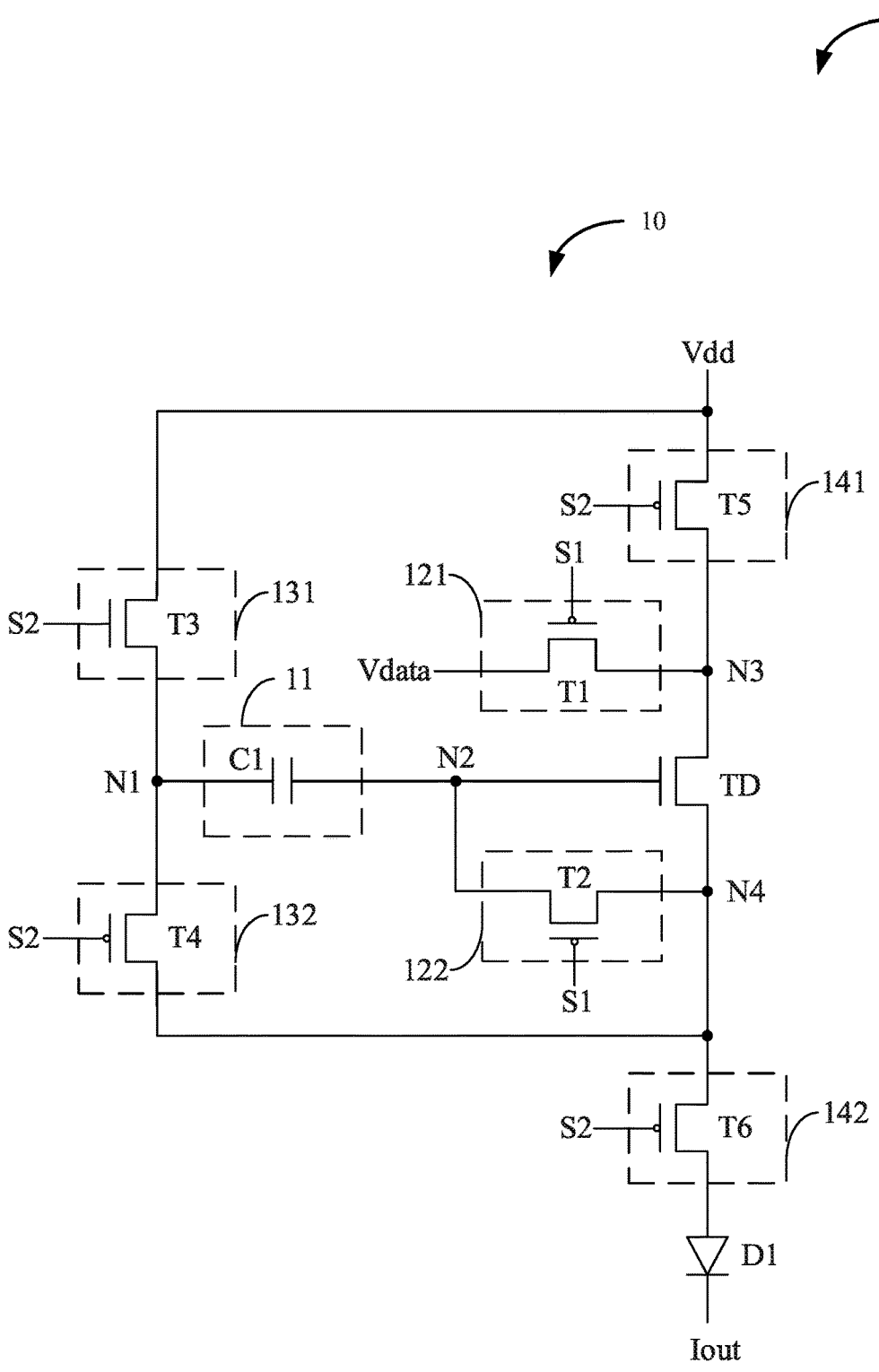
FIG. 3 shows a circuit structural diagram of a first pixel driving circuit according to an embodiment of the present disclosure.

FIG. 3 is a circuit structural diagram 300 of a pixel driving circuit 10 according to an embodiment of the present disclosure. The pixel driving circuit gives an exemplary structure of each sub-circuit on the basis of the structure shown in FIG. 1. In the present example, the second scan line S2 and the third scan line S3 in FIG. 1 are the same scan line, and are represented by a single line, the second scan line S2 in FIG. 3. The first level of the third scan line S3 is the second level of the second scan line S2, and the second level of the third scan line S3 is the first level of the second scan line S2.

Referring to FIG. 3, the voltage holding sub-circuit 11 includes a first capacitor C1. The first end of the first capacitor C1 is the first end of the voltage holding sub-circuit 11, and the second end of the first capacitor C1 is the second end of the voltage holding sub-circuit 11. Since the electric charge can be stored in the first capacitor C1, and the first capacitor C1 is characterized to maintain a voltage between the both ends when the amount of stored electric charge is constant, the voltage between the first and second ends of the voltage holding sub-circuit 11 can be kept constant.

Referring to FIG. 3, in the data writing sub-circuit, the first data writing sub-circuit 121 includes a first transistor T1, and the second data writing sub-circuit 122 includes a second transistor T2. The first scan line S1 is connected to a gate of the first transistor T1, the first pole of the first transistor T1 is connected to a signal line that supplies the data voltage Vdata, and the second pole of the first transistor T1 is connected to the first pole of the drive transistor TD. The gate of the second transistor T2 is connected to the first scan line S1, the first pole of the second transistor T2 is connected to the first end of the voltage holding sub-circuit 11, and the second pole of the second transistor T2 is connected to the second pole of the driving transistor TD. In this example, the first transistor T1 and the second transistor T2 are both P-type thin film transistors.

When the first scan line S1 is at a low level as the first level, both the first transistor T1 and the second transistor T2 are turned on (for example, operating in a linear region or a saturation region), so that the signal line for providing the data voltage Vdata can pass. The first transistor T1 supplies the modified data voltage Vdata to the first pole of the driving transistor TD (at the second node N2), and the second transistor T2 is electrically connected to the gate of the driving transistor TD and the second pole via the second node N2 and the fourth node N4, respectively, thus realizing the function of the data writing sub-circuit described above.

In the conversion sub-circuit, the first conversion sub-circuit 131 includes a third transistor T3, and the second conversion sub-circuit 132 includes a fourth transistor T4. The gate of the third transistor T3 is connected to the second scan line S2, the first pole of the third transistor T3 is connected to the signal line for providing the illumination power supply voltage Vdd, and the second pole of the third transistor T3 is connected to the second end of the voltage holding sub-circuit 11. The gate of the fourth transistor T4 is connected to the second scan line S2, the first pole of the fourth transistor T4 is connected to the second end of the voltage holding sub-circuit 11, and the second pole of the fourth transistor T4 is connected to the second pole of the driving transistor TD. In this example, the third transistor T3 is an N-type thin film transistor, and the fourth transistor T4 is a P-type thin film transistor. When the second scan line S2 is at a high level such as the first level, the signal line supplying the illumination power supply voltage Vdd can pass through the third transistor T3 onto the second end of the voltage holding sub-circuit 11 (at the first node N1). In this way, a illumination power supply voltage Vdd is provided to the voltage holding sub-circuit 11. When the second scan line S2 is at a low level such as the second level (i.e. a first level on the third scan line S3), the fourth transistor T4 electrically connects the second end of the voltage holding sub-circuit 11 and the second pole of the driving transistor TD, that is, the first node N1 and the fourth node N4 are turned on. In this way, the function of the conversion sub-circuit described above can be achieved.

In the switch sub-circuit, the first switch sub-circuit 141 includes a fifth transistor T5, and the second switch sub-circuit 142 includes a sixth transistor T6. The gate of the fifth transistor T5 is connected to the second scan line S2, the first pole of the fifth transistor T5 is connected to the signal line for providing the illumination power supply voltage Vdd, and the second pole of the fifth transistor T5 is connected to the first pole of the driving transistor TD. The gate of the sixth transistor T6 is connected to the second scan line S2, the first pole of the sixth transistor T6 is connected to the second pole of the driving transistor TD, and the second pole of the sixth transistor T6 is connected to the current output terminal Tout of the pixel driving circuit. In this example, the fifth transistor T5 and the sixth transistor T6 are both P-type thin film transistors. When the second scan line S2 is at the second level (i.e. a first level on the third scan line S3), the signal line supplying the illumination power supply voltage Vdd can pass through the fifth transistor T5. The illumination power supply voltage Vdd is supplied to the first pole of the driving transistor TD (at the third node N3), and the sixth transistor T6 is capable of electrically connecting the second pole of the driving transistor TD (ie, at the fourth node N4) and the current output terminal Tout of the driving circuit, thus achieving the above function of the switch sub-circuit.

Figure 4:
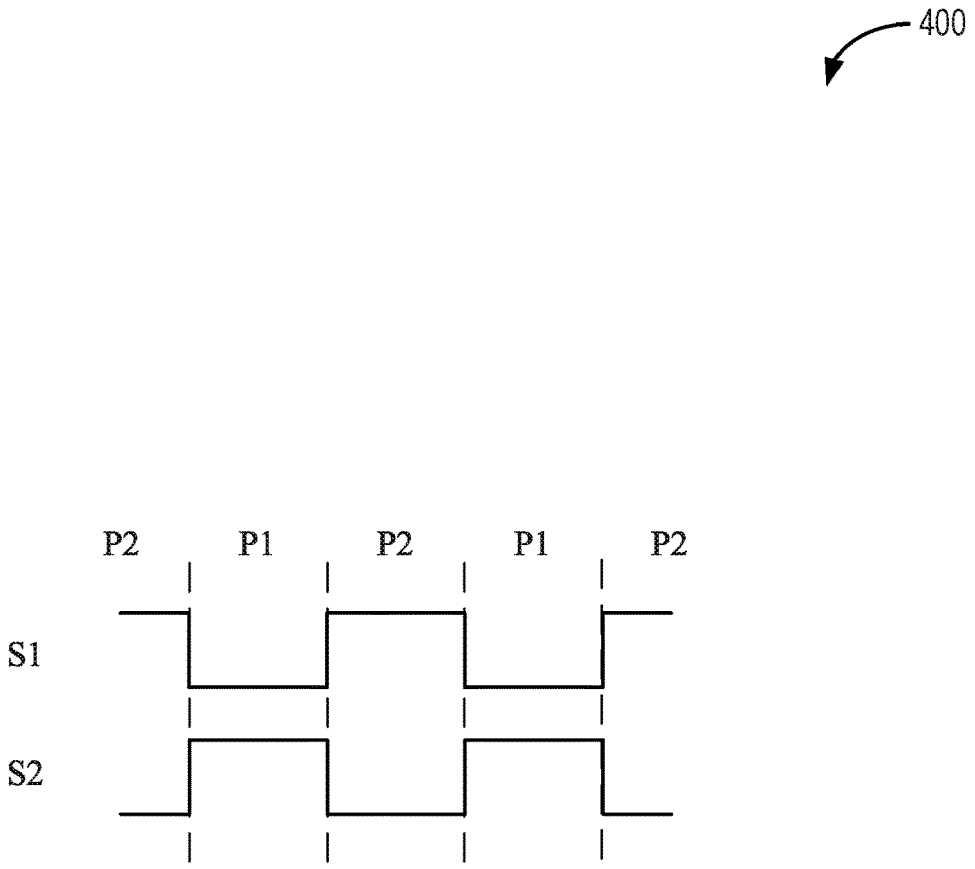
FIG. 4 shows a circuit timing diagram of the first pixel driving circuit according to an embodiment of the present disclosure.

FIG. 4 is a circuit timing diagram 400 of the pixel driving circuit shown in FIG. 3. Referring to FIGS. 3 and 4, operation of the pixel driving circuit includes alternations of a data writing phase P1 and an illumination phase P2 in each display period (each display period may, for example, be one display frame).

At the beginning of each data writing phase P1, the first scan line S1 changes from a high level to a low level, the second scan line S2 changes from a low level to a high level, and the turned-on transistors comprise a first transistor T1, a second transistor T2 and a third transistor T3. Thereby, the signal line providing the data voltage Vdata can supply the data voltage Vdata to the third node N3 through the first transistor T1, and the second transistor T2 can connect the second node N2 to the fourth node N4. The signal line supplies illumination power supply voltage Vdd to the first node N1 via the third transistor T3, such that the voltage at the second node N2 where the first end of the first capacitor C1 is located becomes the sum of the data voltage Vdata and the threshold voltages Vth of the driving transistor TD, wherein the voltage at the first node N1 where the second end of the first capacitor C1 is located is Vdd, so that the data voltage Vdata and the threshold voltage Vth of the driving transistor TD are written in the form of charging the first capacitor C1.

At the beginning of each illumination phase P2, the first scan line S1 changes from a low level to a high level, and the second scan line S2 changes from a high level to a low level, and each of the first transistor T1, the second transistor T2, and the third transistor T3 are all turned off (for example, operating in the cut-off region), and each of the fourth transistor T4, the fifth transistor T5, and the sixth transistor T6 are turned on. The fourth transistor T4 turns on the first node N1 and the fourth node N4 to provide illumination power supply voltage. The signal line of the power supply voltage Vdd supplies the illumination power supply voltage Vdd to the third node N3 through the fifth transistor T5, and the sixth transistor T6 electrically connects the fourth node N4 and the current output terminal Tout, so that the signal line for providing the illumination power supply voltage Vdd can pass. The fifth transistor T5, the driving transistor TD, and the sixth transistor T6 supply a illumination current to the current output terminal Tout, and the magnitude of the illumination current is controlled by the operating state of the driving transistor TD. At this time, since the fourth transistor T4 turns on the first node N1 and the fourth node N4, the voltage Vn2 at the second node N2 becomes Vdata+Vth-Vdd+Vn4 under the action of the first capacitor C1, thereby driving the transistor TD.

The source-drain current Ids, that is, the magnitude of the illumination current of the TD is equal to the above $K[Vdata-Vdd]^2$ (as shown in equation 1), and it can be seen that the magnitude of the illumination current is related to the data voltage Vdata and the illumination power supply voltage Vdd regardless of the threshold voltage Vth of the driving transistor TD. It can be inferred that the pixel driving circuit completes the writing of the data voltage Vdata and the threshold voltage Vth in the data writing phase P1 of each display period, and supplies the current output terminal Tout according to the magnitude of the data voltage Vdata in the subsequent illumination phase P2. In this way, the uniformity of the illumination currents provided by the different pixel driving circuits under the same data voltage Vdata is not affected by the difference of the threshold voltages Vth of the different driving transistors TD, and the threshold voltage Vth of each driving transistor TD changes with time. Also, the magnitude of the illumination current provided by the pixel driving circuit at the same data voltage Vdata is not affected by the threshold voltage of the driving transistor. Therefore, the embodiments of the present disclosure can improve the brightness uniformity of a display device of a current-driven illumination type such as an OLED display, contributing to an improvement in display performance and reliability of the display device.

In addition, as can be seen from FIG. 4, since the signal on the first scan line S1 and the signal on the second scan line S2 are always inverted from each other, the same scan line can be used simultaneously as the second scan line S2 and the third scan line S3 (as shown in FIG. 3). For example, when the signal on the scan line is the signal on the first scan line S1 in FIG. 4, the third transistor T3 in FIG. 3 needs to be changed from the N type to the P type, and the fourth transistor T4, The five transistors T5, and the sixth transistor T6 in FIG. 3 need to be changed from the P type to the N type so that the pixel driving circuit still operates in accordance with the above process. For another example, when the signal on the scan line is the signal on the second scan line S2 in FIG. 4, the first transistor T1 and the second transistor T2 in FIG. 3 need to be changed from P type to N type to make the pixel drive circuit function according to the above process.

Figure 5:
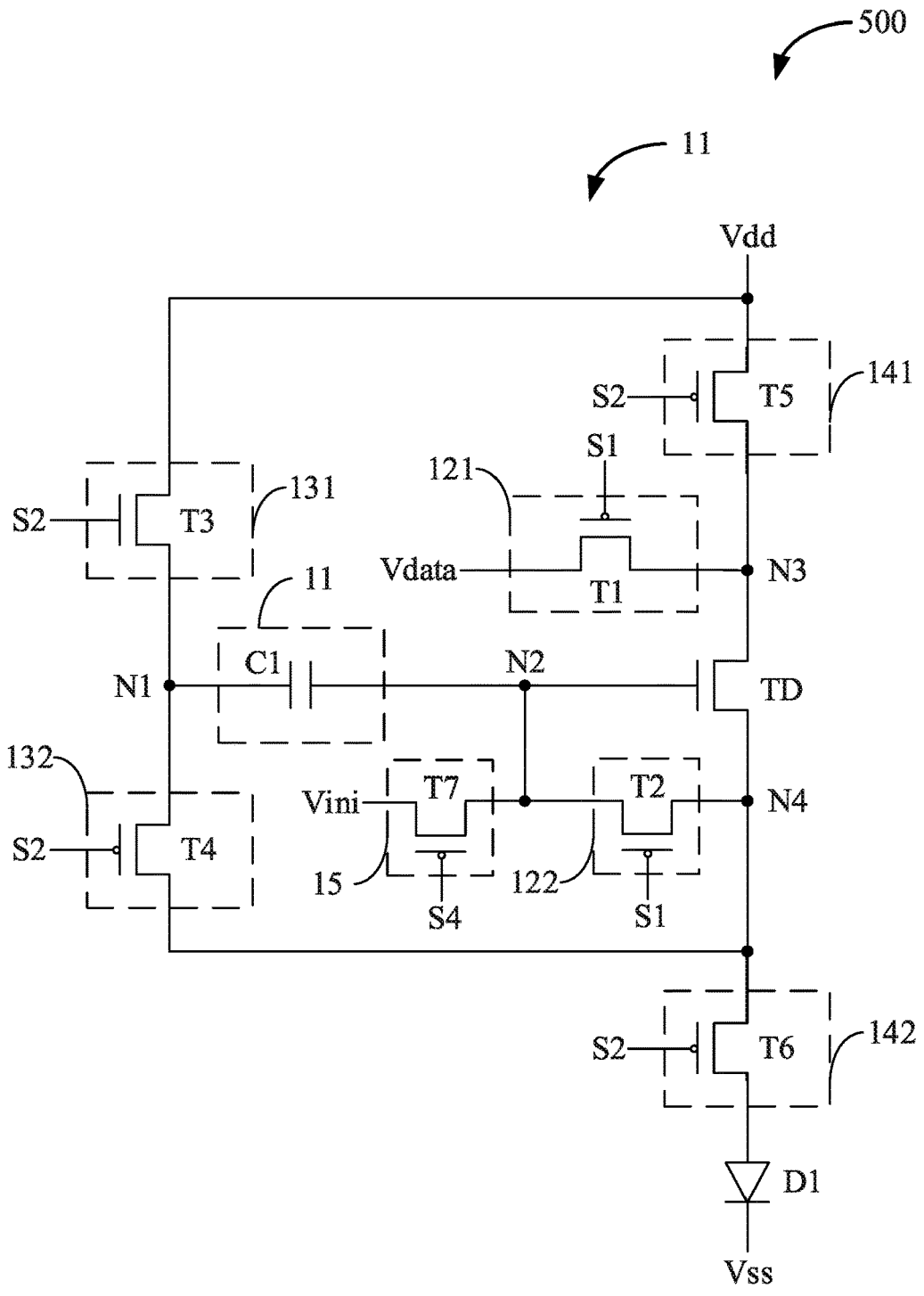
FIG. 5 shows a circuit structural diagram of a second pixel driving circuit according to an embodiment of the present disclosure.
Figure 6:
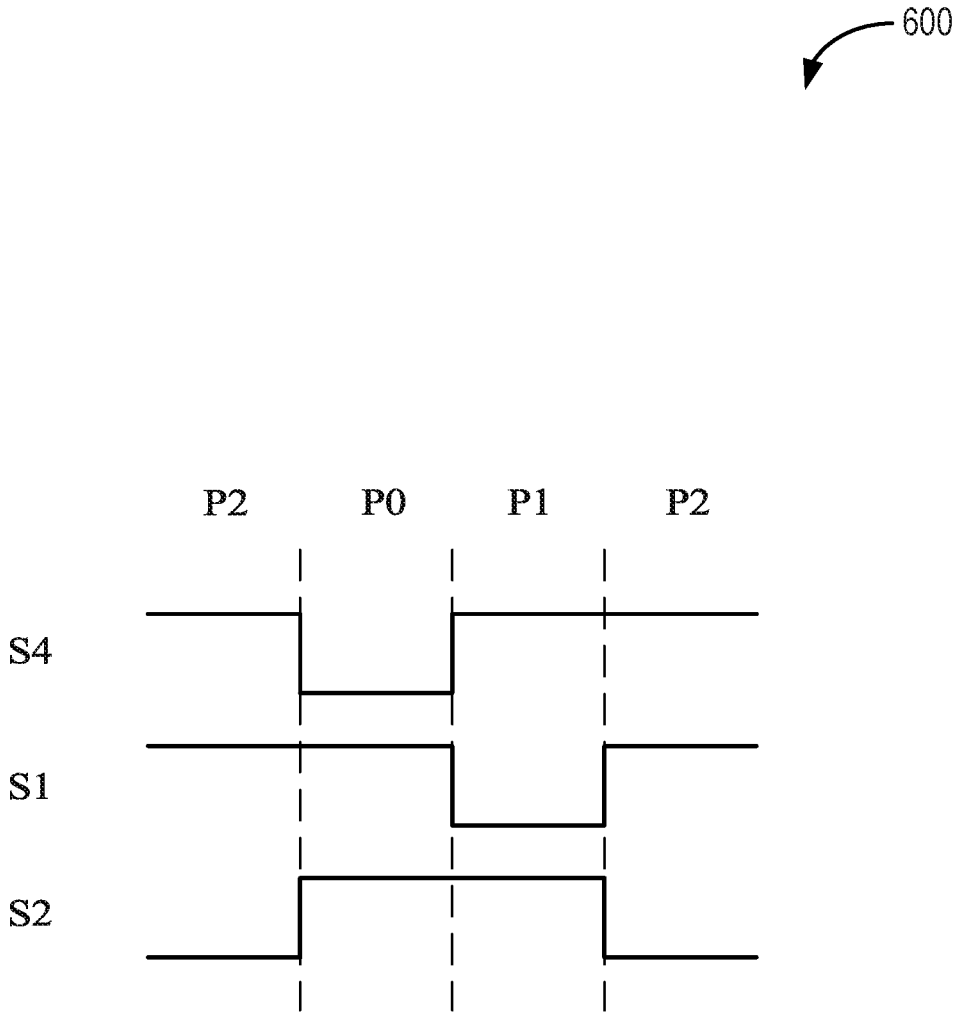
FIG. 6 is a circuit timing diagram of the second pixel driving circuit according to an embodiment of the present disclosure.

FIG. 5 is a circuit configuration diagram 500 of still another pixel driving circuit 11 according to an embodiment of the present disclosure, and FIG. 6 is a circuit timing diagram 600 of the pixel driving circuit shown in FIG. 5. The pixel driving circuit 11, as shown in FIG. 5, has an initialization sub-circuit 15 added to the pixel driving circuit 10 shown in FIG. 3. Parts of the pixel driving circuit previously described are numbered similarly and not re-introduced. The initializing sub-circuit 15 is connected to the fourth scanning line S4 and the first end of the voltage holding sub-circuit 11, respectively, for supplying an initializing voltage (Vini) to the first end of the voltage holding sub-circuit 11 when the fourth scanning line S4 is at the first level. As an example, the initialization sub-circuit 15 may include a seventh transistor T7 whose gate is connected to the fourth scan line S4. The first pole of the seventh transistor T7 is connected to the first end of the voltage holding sub-circuit 11 (at the second node N2), and the second pole of the seventh transistor T7 is connected to provide a signal line of the initialization voltage Vini. Referring to FIGS. 5 and 6, the seventh transistor T7 is a P-type thin film transistor, and the fourth scan line S4 is a first (low) level in the initialization phase P0 before the data writing phase P1 of each display period. Therefore, the seventh transistor T7 is turned on at the beginning of the initialization phase P0, so that the signal line providing the initialization voltage Vini can supply the initialization voltage Vini to the second node N2 through the seventh transistor T7, at which time all the transistors except the third transistor T3 are turned off. Therefore, the first end of the first capacitor C1 changes to the initialization voltage Vini, and the second end is converted to the illumination power supply voltage Vdd.

It should be understood that the magnitude of the initialization voltage Vini may be set, for example, to a value greater than any of the possible values of Vdata+Vth, thereby facilitating the smooth transition of the second node N2 to Vdata in the data writing phase P1. It should also be understood that in an implementation such as the structure in which the drive transistor TD has a source and a drain symmetry, the above mentioned initialization sub-circuit 15 and the initialization phase P0 may be excluded because in this case, whether Vdata+Vth is higher or lower than the initial potential at the second node N2, at the beginning of P1, the second node N2 can smoothly change to Vdata+Vth. For the case where the initialization sub-circuit 15 is included in the pixel driving circuit, the driving method may further include: before the step 201 (in FIG. 2), providing a first level to the fourth scan line S4, so that the voltage holding sub-circuit 11 (the voltage at the first end) is set to the initialization voltage Vini. The circuit timing shown in FIG. 6 can be regarded as an exemplary implementation manner of the method.

Based on the same inventive concept, still another embodiment of the present disclosure provides a display device including at least one of the pixel driving circuits of any of the above. The display device in the embodiment of the present disclosure may be any product or component having a display function such as a display panel, a mobile phone, a tablet computer, a television, a display, a notebook computer, a digital photo frame, a navigator, and the like. The display device can also achieve the same or corresponding beneficial effects based on the beneficial effects that the array substrate can achieve.

Figure 7:
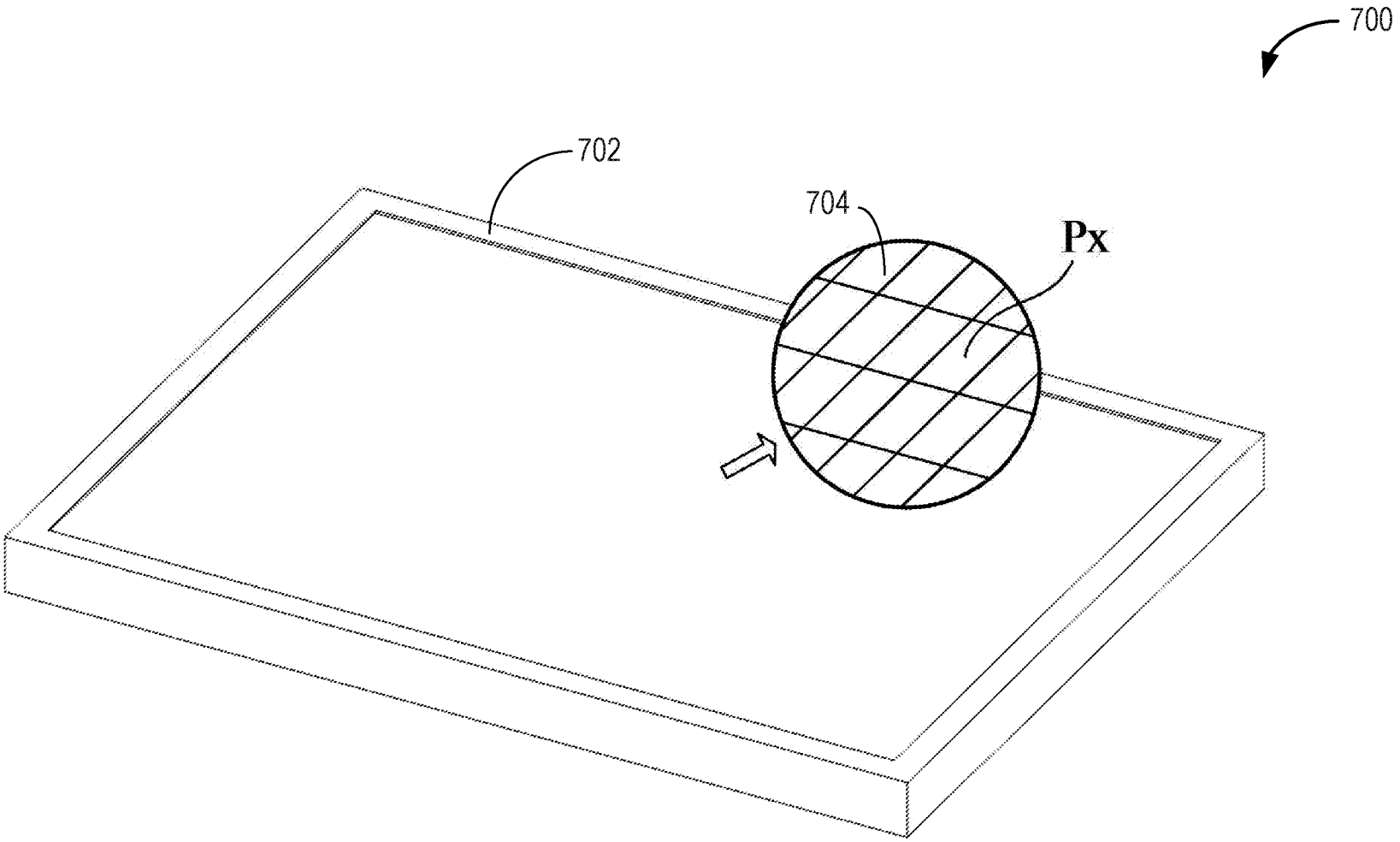
FIG. 7 is a schematic structural diagram of a display device according to an embodiment of the present disclosure.

FIG. 7 is a schematic structural diagram 700 of a display device 702 according to an embodiment of the present disclosure. In one example, the display device 702 may be the display device 101 in FIG. 2. Referring to FIG. 7, the effective display area 704 of the display device 702 includes sub-pixel regions Px arranged in rows and columns, and each of the sub-pixel regions Px is provided with one of the above-mentioned pixel driving circuits, so that the threshold voltage compensation function can be realized by using the threshold voltage compensation function to achieve luminous uniformity and reliability.

It will be appreciated that the various embodiments of the present disclosure are described in a progressive manner, wherein each embodiment focuses on differences from other embodiments, and similar parts between the various embodiments may be referred to each other.

It will be appreciated that ordinal terms such as "first" and "second" are used merely to distinguish one entity or operation from another entity or operation, and do not necessarily require or imply any such actual relationship or order between these entities or operations.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

It is to be understood that the above embodiments are merely exemplary embodiments employed to explain the principles of the inventive concepts, but the inventive concepts are not limited thereto. Various modifications and improvements can be made by those skilled in the art without departing from the spirit and scope of the disclosure, and such modifications and improvements are also considered to be within the scope of the disclosure.

The invention claimed is:

1. A pixel driving circuit, wherein the pixel driving circuit comprises:

a driving transistor;

a voltage holding sub-circuit with a first end of the voltage holding sub-circuit coupled to a gate of the driving transistor, the voltage holding sub-circuit configured to maintain a voltage between the first end and a second end of the voltage holding sub-circuit;

a data writing sub-circuit respectively coupled to a first scan line, a gate, a first pole and a second pole of the driving transistor, the data writing sub-circuit configured to provide a modified data voltage to the first pole of the driving transistor when the first scan line is at a first level, and electrically connect the gate of the driving transistor and the second pole of the driving transistor;

a conversion sub-circuit comprising a third transistor and a fourth transistor, the conversion sub-circuit respectively coupled to a second scan line, the second pole of the driving transistor, and the second end of the voltage holding sub-circuit, the conversion sub-circuit configured to provide an illumination power supply voltage to the second end of the voltage holding sub-circuit when the second scan line is at a second level, and connect the second end of the voltage holding sub-circuit and the second pole of the driving transistor when the second scan line is at the second level; and a switch sub-circuit comprising a fifth transistor and a sixth transistor, the switch sub-circuit respectively connected to the second scan line, a current output terminal of the pixel driving circuit, and the first and the second poles of the driving transistor, the switch sub-circuit configured to provide the illumination power supply voltage to the first pole of the driving transistor when the second scan line is at the second level, and connect the second pole of the driving transistor and the current output terminal of the pixel driving circuit;

wherein the first pole and the second pole of the driving transistor are one of a source and a drain, respectively, and wherein gate electrodes of the third transistor, the fourth transistor, the fifth transistor, and the sixth transistor are connected to the second scan line, and when the second scan line is at the second level, the third transistor is configured to be in an off state while the fourth transistor, the fifth transistor, and the sixth transistor are configured to be in an on state;

wherein a first pole of the third transistor is directly connected to a first pole of the fifth transistor and a signal line providing the illumination power supply voltage, wherein a second pole of the third transistor is directly connected to the second end of the voltage holding sub-circuit and a first pole of the fourth transistor, and wherein a second pole of the fourth transistor is directly connected to a first pole of the sixth transistor and the second pole of the driving transistor.

2. The pixel driving circuit of claim 1, wherein a first level on the second scan line corresponds to but is a different voltage value than the second level on the second scan line.

3. The pixel driving circuit of claim 1, wherein the voltage holding sub-circuit comprises a first capacitor with a first end of the first capacitor being the first end of the voltage holding sub-circuit and a second end of the first capacitor being the second end of the voltage holding sub-circuit.

4. The pixel driving circuit of claim 3, wherein the data writing sub-circuit comprises a first transistor and a second transistor, wherein a gate of the first transistor is connected to the first scan line, a first pole of the first transistor is connected to a signal line providing the modified data voltage, and a second pole of the first transistor is connected to the first pole of the driving transistor, and wherein a gate of the second transistor is connected to the first scan line, a first pole of the second transistor is connected to the first end of the voltage holding sub-circuit, and a second pole of the second transistor is connected to the second pole of the driving transistor.

5. The pixel driving circuit of claim 1, wherein second pole of the fifth transistor is connected to the first pole of the driving transistor, and wherein a second pole of the sixth transistor is connected to the current output terminal of the pixel driving circuit.

6. The pixel driving circuit of claim 1, wherein the pixel driving circuit further comprises an initializing sub-circuit, wherein the initializing sub-circuit is connected to each of a fourth scan line and first end of the voltage holding sub-circuit, the initialization sub-circuit providing an initialization voltage to the first end of the voltage holding sub-circuit when the fourth scan line is at a first level.

7. The pixel driving circuit of claim 6, wherein the initializing sub-circuit comprises a seventh transistor, wherein a gate of the seventh transistor is connected to the fourth scan line, a first pole of the seventh transistor is connected to the first end of the voltage holding sub-circuit, and a second pole of the seventh transistor is connected to a signal line providing the initialization voltage.

8. The pixel driving circuit of claim 6, wherein the pixel driving circuit is incorporated in a display device, the display device comprising at least one pixel driving circuit.

9. A method of driving a pixel driving circuit comprising:

providing a first level to a second scan line to set a voltage at a second end of a voltage holding sub-circuit to an illumination power supply voltage;

providing a first level to a first scan line to set a voltage at a first end of the voltage holding sub-circuit to a sum of a data voltage and a threshold voltage of a driving transistor; and providing a second level to a second scan line to electrically connect a current output terminal of the pixel driving circuit to each of the first end of the voltage holding sub-circuit and a second end of the driving transistor, and setting a voltage at a first pole of the driving transistor to the illumination power supply voltage;

providing the illumination power supply voltage to the second end of the voltage holding sub-circuit when the second scan line is at a first level using a conversion sub-circuit comprising a third transistor and a fourth transistor; and connecting a second pole of the driving transistor and the current output terminal of the pixel driving circuit using a switch sub-circuit comprising a fifth transistor and a sixth transistor;

wherein gate electrodes of the third transistor, the fourth transistor, the fifth transistor, and the sixth transistor are connected to the second scan line, and when the second scan line is at the second level, the third transistor is configured to be in an off state while the fourth transistor, the fifth transistor, and the sixth transistor are configured to be in an on state, wherein a first pole of the third transistor is directly connected to a first pole of the fifth transistor and a signal line providing the illumination power supply voltage, wherein a second pole of the third transistor is directly connected to the second end of the voltage holding sub-circuit and a first pole of the fourth transistor, and wherein a second pole of the fourth transistor is directly connected to a first pole of the sixth transistor and the second pole of the driving transistor.

10. The method according to claim 9, further comprising, providing an initialization voltage to the first end of the voltage holding sub-circuit when a fourth scan line is at a first level.

11. The method of claim 10, wherein the initialization voltage is provided through a pixel initializing sub-circuit connected to each of the fourth scan line and the first end of the voltage holding sub-circuit of the pixel driving circuit.

12. The method of claim 10, wherein the current output terminal of the pixel driving circuit supplies an illumination current to a light emitting device, one or more light emitting devices forming sub-pixels in a display.

13. The method of claim 12, wherein the illumination current is a function of the illumination power supply voltage supplied at a switch sub-circuit of the pixel driving circuit and a data voltage supplied at a data writing sub-circuit, the illumination current independent of the threshold voltage of the driving transistor.

14. The method of claim 10, wherein the providing the first level to the second scan line is during a data writing phase in a display period, wherein the providing the first level to the first scan line is during the data writing phase, and the providing the second level to the second scan line is during an illumination phase in the display period.

15. The method of claim 10, wherein each of the first level at the first scan line, the first level at the second scan line, and the second level at the second scan line provide distinct preset voltage ranges.

16. A display device comprising:

sub-pixel regions arranged in rows and columns, each of the sub-pixel regions comprises a pixel driving circuit including each of a driving transistor, a voltage holding sub-circuit coupled to a gate of the driving transistor, a data writing sub-circuit coupled to the gate, a first pole and a second pole of the driving transistor and a first scan line, a conversion sub-circuit, comprising a third transistor and a fourth transistor, coupled to a second scan line, the second pole of the driving transistor, and a second end of the voltage holding sub-circuit, a switch sub-circuit, comprising a fifth transistor and a sixth transistor, coupled to the second scan line, the conversion sub-circuit, a current output terminal, and the first and the second poles of the driving transistor, wherein the first pole and the second pole of the driving transistor are one of a source and a drain, wherein gate electrodes of the third transistor, the fourth transistor, the fifth transistor, and the sixth transistor are connected to the second scan line, and when the second scan line is at a second level, the third transistor is configured to be in an off state while the fourth transistor, the fifth transistor, and the sixth transistor are configured to be in an on state, wherein a first pole of the third transistor is directly connected to a first pole of the fifth transistor and a signal line providing an illumination power supply voltage, wherein a second pole of the third transistor is directly connected to the second end of the voltage holding sub-circuit and a first pole of the fourth transistor, and wherein a second pole of the fourth transistor is directly connected to a first pole of the sixth transistor and the second pole of the driving transistor.

17. The display device of claim 16, wherein the voltage holding sub-circuit is configured to maintain a voltage between a first end and a second end of the voltage holding sub-circuit;

the data writing sub-circuit is configured to provide a modified data voltage to the first pole of the driving transistor when the first scan line is at a first level;

the conversion sub-circuit is configured to provide the illumination power supply voltage to the second end of the voltage holding sub-circuit when the second scan line is at the second level, and connect the second end of the voltage holding sub-circuit and the second pole of the driving transistor when the second scan line is at the second level; and the switch sub-circuit is configured to provide the illumination power supply voltage to the first pole of the driving transistor when the second scan line is at the second level, and connect the second pole of the driving transistor and the current output terminal of the pixel driving circuit.

18. The display device of claim 17, wherein the voltage holding sub-circuit comprises a first capacitor with a first end of the first capacitor being the first end of the voltage holding sub-circuit and a second end of the first capacitor being the second end of the voltage holding sub-circuit; and wherein the data writing sub-circuit comprises a first transistor and a second transistor, wherein a gate of the first transistor is connected to the first scan line, a first pole of the first transistor is connected to a signal line providing the modified data voltage, and a second pole of the first transistor is connected to the first pole of the driving transistor, and wherein a gate of the second transistor is connected to the first scan line, a first pole of the second transistor is connected to the first end of the voltage holding sub-circuit, and a second pole of the second transistor is connected to the second pole of the driving transistor.

19. The display device of claim 17, wherein a second pole of the fifth transistor is connected to the first pole of the driving transistor, and wherein a second pole of the sixth transistor is connected to the current output terminal of the pixel driving circuit.

* * * * *